United States Patent [19]

Tompa et al.

[11] 4,098,627

[45] Jul. 4, 1978

[54] SOLVOLYTIC DEGRADATION OF PYROTECHNIC MATERIALS CONTAINING CROSSLINKED POLYMERS

[75] Inventors: Albert S. Tompa, Indian Head, Md.; David M. French, Alexandria, Va.; George B. Butler, Gainesville, Fla.; Melvin S. Kaufman, Augusta, Ga.

[73] Assignee: The United States of America as represented by the Secretary of the Navy, Washington, D.C.

[21] Appl. No.: 750,990

[22] Filed: Dec. 15, 1976

[51] Int. Cl.[2] ..... C06B 45/10

[52] U.S. Cl. ..... 149/109.6; 149/19.92; 149/92; 264/3 R

[58] Field of Search ..... 149/19.92, 109.6, 19.4, 149/92; 264/3 R

[56] References Cited

U.S. PATENT DOCUMENTS

| | | | |
|---|---|---|---|
| 3,451,789 | 6/1969 | McIntosh | 149/19.92 X |
| 3,897,237 | 7/1975 | Musselman et al. | 149/19.92 X |
| 3,909,497 | 9/1975 | Hendry et al. | 149/19.4 X |
| 3,968,723 | 7/1976 | Falterman et al. | 149/109.6 X |
| 4,018,636 | 4/1977 | O'Neill et al. | 149/92 X |

*Primary Examiner*—Edward A. Miller
*Attorney, Agent, or Firm*—R. S. Sciascia; A. L. Branning; H. B. Field

[57] ABSTRACT

Pyrotechnic materials containing a crosslinked polymer as a component thereof are decomposed by heating to a temperature of about 50° to about 160° C in a liquid medium comprising an active hydrogen containing compound capable of cleaving the chemical bonds contained in said polymer. One or more components of the pyrotechnic material may be separated from the products of the decomposition and reclaimed.

22 Claims, No Drawings

SOLVOLYTIC DEGRADATION OF PYROTECHNIC MATERIALS CONTAINING CROSSLINKED POLYMERS

BACKGROUND OF THE INVENTION

This invention relates to a method for the decomposition of pyrotechnic materials which contain a cured or crosslinked organic polymer as a component thereof. Some examples of pyrotechnic materials which can be decomposed according to the present method include composite propellants, plastic bonded explosives, and liners and inhibitors for solid propellant motor casings and cartridge shells.

Every year, large amounts of pyrotechnic materials must be disposed of due to deterioration or obsolence. In the past, pyrotechnics have been disposed of by dumping them in the ocean, burning them in an open area, or detonating them in a safe zone. Viewed from an ecological standpoint these methods are undesirable because they contribute to contamination of the ocean, and to pollution of the atmosphere by releasing corrosive hydrogen chloride gas and noxious oxides of nitrogen into the air. Because of concern over minimizing all sources of environmental pollution, the need exists for an ecologically sound alternative method for disposing of unwanted pyrotechnic materials.

In addition to being inexpedient from an ecological standpoint the previous methods of disposal are unsatisfactory from an economic point of view. The utter waste of valuable raw materials which are used in the preparation of pyrotechnic materials is readily apparent when methods such as those mentioned above are employed for the disposal of these items. Accordingly, it would be desirable to develop a process whereby some or all of the components which make up the pyrotechnic materials could be recovered and reused.

Several methods have been proposed in the prior art for the solvolytic decomposition of polymeric materials. One such method involves heating polyurethanes in the presence of the polyol used to prepare the original polymer, as disclosed by Ten Broeck in U.S. Pat. No. 2,937,151. Other methods involve heating polyurethanes in the presence of a primary amine, as disclosed by McElroy in U.S. Pat. No. 3,117,940, or heating polyurethanes in the presence of an amine in combination with a strong base, as disclosed by Matsudaira et al in U.S. Pat. No. 3,404,103. More recently, Frulla et al have described a process for the decomposition of scrap polyurethane foam by heating in the presence of a mixture of an aliphatic diol and a dialkanolamine. Some of the above described prior art methods do not provide for recovery of the chemical components of the decomposed polymeric material, while others utilize some combination of high temperature, high pressure or high alkali concentration, which conditions are not compatible with the recovery of pyrotechnic materials components due to their instability. The present method, by contrast, employs relatively mild conditions and permits the recovery of several valuable components.

SUMMARY OF THE INVENTION

Accordingly, there is provided by the present invention an ecologically and economically attractive method for the disposal or decomposition of pyrotechnic materials containing cured polymeric components. The method involves heating the pyrotechnic material to a temperature of about 50° to about 160° C in a liquid medium comprising an active hydrogen containing compound capable of cleaving the chemical bonds contained in the polymer. One or more of the products resulting from the decomposition of the pyrotechnic material can be separated and recovered. The active hydrogen containing compounds which can be used in practicing the invention include primary amines, secondary amines, ammonia, mineral acids and water.

OBJECTS OF THE INVENTION

It is therefore an object of the present invention to provide a simple and practical process for the disposal of pyrotechnic materials resulting in substantially reduced emission of environmental pollutants as compared with hitherto available methods.

It is also an object of the present invention to provide an economically viable process for the reclamation of pyrotechnic materials.

It is a further object of this invention to provide a quick and effective method for the disposal of pyrotechnic materials which employs relatively mild processing conditions, and thus minimizes the risk involved in working with such unstable and potentially dangerous materials.

Other objects and many of the attendant advantages of this invention will be readily appreciated as the same becomes better understood by reference to the following detailed description of the preferred embodiments.

DESCRIPTION OF THE PREFERRED EMBODIMENTS

In accordance with the present invention pyrotechnic materials having crosslinked polymeric binder systems can be ecologically and economically decomposed, while concurrently facilitating the reclamation of various filler materials. Although many pyrotechnic systems can be treated by the method disclosed herein, composite propellants are of particular interest both because of their compositions, and quantity of material disposed of annually.

Composite propellants are non-homogenous suspensions of fillers which include crystalline oxidizers and metallic fuels, in a crosslinked polymeric binder system. Typically, oxidizers are the major ingredient and can be selected from lithium, sodium, potassium and ammonium nitrate; lithium sodium, potassium, and ammonium perchlorate, and nitronium perchlorate; cyclotrimethylene trinitramine, RDX; cyclotetramethylene tetranitramine, HMX; and nitroguanidine. The preferred group of oxidizers include ammonium perchlorate, ammonium nitrate, RDX, HMX, and nitroguanidine while the most preferred oxidizer is ammonium perchlorate.

Likewise, even though aluminum is the most preferred metallic fuel for composite propellants, metallic fuels of zirconium, magnesium, boron, lithium and beryllium are also used.

Polymeric binder systems for composite propellants, many adhesives, and sealants use prepolymer technology in which chemically reactive groups on low melecular weight polymers are reacted with polyfunctional isocyanates, imines or epoxides to produce high molecular weight, three dimensional structures. At the point of combination, the isocyanates form urethane crosslinking groups, the imines form amide and ester crosslinking groups, and the epoxides form ester crosslinking groups.

The isocyanates most commonly used in the preparation of polyurethane propellant binders are 2,4-tolyene diisocyanate, hexamethylene diisocyanate, polymethylene polyphenylisocyanate and dianisidine diisocyanate, however, 3-nitrazapentane diisocyanate has also been employed in specialized situations. To these polyurethanes, a three dimensional molecular structure can be imparted by the addition of trifunctional crosslinking agents. Examples of these crosslinkers are trifunctional alcohols such as glycerol, trimethylolpropane and 1,2,6-hexantriol, and their propylene oxide adducts as well as glycerol monoricinoleate, glycerol triricinoleate, triethanolamine and toluene -2,4,6-triisocyanate. Other suitable starting materials for the preparation of polyurethane propellants can be found in U.S. Pat. No. 3,141,294 the disclosure of which is incorporated herein by reference.

The typical imine curing agents are generically referred to as aziridines, examples of which are tris (2-methylaziridinyl-1) phosphine oxide, 1,3,5-tris (2-ethylaziridinyl-1) adduct of trimesic acid, 2,4,6-tris (2-ethylaziridinyl-1)-S-triazine, $\alpha,\omega$- bis (2-ethylaziridinyl-1) adduct of isosebasic acid, and 1,4-bis(2-ethylaziridinyl-1) adduct of isophthalic acid.

Representative epoxide curing agents include low molecular weight condensation products of epichlorohydrin with glycerol such as Epon 812 manufactured by the Shell Chemical Co., the triepoxide of p-aminophenol and glycidyl ether, an example of which is manufactured and sold by the Union Carbide Co., under the name ERLA-0510, the triepoxide of phenol and glycidyl ether, also made by the Shell Chemical Co., and the diepoxide of bisphenol A, such as DER-332, manufactured by Dow Chemical Co.

Another class of pyrotechnic materials which can be decomposed or degraded according to the present invention is plastic bonded explosives (PBX). The plastic binders of the explosives which have been tested are prepared in a manner similar to that described above in regard to the polyurethane, polyamide and polyester based composite propellants. Plastic bonded explosives of this type generally contain oxidizers, such as ammonium perchlorate or RDX and energetic nitrate ester plasticizers such as pentaerythritol tetranitrate.

Crosslinked polymeric bound pyrotechnic materials represented by those just described are readily decomposed by heating in the presence of liquid active hydrogen containing compounds such as alcohols, water, primary amines, secondary amines, ammonia, and mineral acids. Compatible mixtures of the active hydrogen containing compounds may also be utilized, e.g., mixtures of primary and secondary amines.

A variety of primary and secondary amines are suitable for treating pyrotechnic materials according to the present invention including aromatic, aliphatic, and heterocylclic mono- or polyamines. Suitable amines include diisopropylamine, di-n-butylamine, ethylenediamine, n-butylamine, n-hexylamine, monoethanolamine, 3-propanolamine, diethanolamine, diethylene triamine, tetraethylene pentamine, N,N-dimethyl-1-,3-propanediamine, 3-methoxypropylamine, benzylamine, piperidine, and 3-aminopropylmorpholine.

It should be specially noted that when using an amine in the presence of ammonium perchlorate, shock sensitve substituted ammonim perchlorate can be formed. In these cases, the addition of an aliphatic alcohol would reduce the sensitivity of the ammonium perchlorate by acting as a solvent. Representative alcohols include ethanol, propanol and butanol, however propanol is generally preferred.

Mineral acids suitable for use according to the present invention include hydrochloric acid, sulfuric acid, phosphoric acid, nitric acid and perchloric acid. Perchloric acid is particularly effective when ammonium perchlorate is present as a filler material in the pyrotechnic material and is to be recovered since no foreign anion is introduced into the liquid treating medium, and neutralization of the decomposition products with a solution of aqueous ammonia ($NH_4OH$) simply forms additional ammonium perchlorate.

Although the aforementioned acitve hydrogen containing compounds are capable of effecting decomposition as the sole component of the liquid medium, it has been discovered that the process can be expedited if the liquid medium is modified by the addition of a solvent to the liquid active hydrogen containing compound. The solvent must be both miscible with the active hydrogen containing compound, i.e., the latter must be soluble in the former, and also be capable of placing the polymer under strain. This can be accomplished in two ways, by swelling the organic polymer component of the pyrotechnic material and or by dissolving the filler material present in the pyrotechnic. In those instances where an inorganic salt is used as the filler material, the salt may dissolve in the solvent, and the spaces formerly occupied by filler particles are filled with a solution of the filler in the solvent. It is also postulated that solvent from outside the polymer matrix diffuses into the spaces produced, expands them, and stretches the matrix until the stress on the matrix balances the osmotic pressure of the solution. Solvents which neither swell the polymer matrix nor cause dissolution of the filler material, as described above, are ineffective for use in the present method. It should also be noted that in some instances the active hydrogen containing compound may act as the solvent. Examples of this include water, liquid amine, and liquid ammonia.

Solvents boiling above the temperature of treatment are preferred for use in decomposing pyrotechnic materials according to the present invention. Solvents which have been effective include water, diethylbenzene, xylene, toluene, benzene, perchloroethylene, cyclohexanone, dioxane, ethylene glycol, cyclohexanone and tetrahydrofuran, however those of water, xylene and toluene are preferred.

The reaction temperature will generally be within the range of about 50° to about 160° C. Lower temperatures do not expeditiously bring about cleavage of the chemical bonds contained in the polymer, while higher temperatures tend to destroy the materials desired to be recovered. Normally, reaction temperatures in the range of 80° to 120° C are preferred since most pyrotechnic materials decompose in the liquid medium within this temperature range in a reasonable time. The time of treatment may vary from about 30 minutes to about 15 days.

Optimum reaction conditions are not definable, however, because there is wide latitude in the choice of a particular active hydrogen containing compound, solvent, reaction temperature and reaction time, depending on the polymeric material which is to be decomposed.

As an additional aspect of the present invention, it is possible to further accelerate the rate at which the liquid medium effects decomposition or degradation of the pyrotechnic material by dissolving or dispersing in the liquid medium specific ammonium salts or metal salts. It is preferred that the salt dissolve in the liquid so that the beneficial effect will be more quickly realized. Suitable ammonium salts include but are not limited to ammonium perchlorate, ammonium chloride, ammonium iodide, ammonium bromide, ammonium thiocyanate, ammonium benzoate, ammonium acetate and mixtures thereof. Suitable metal salts include, but are not limited to bismuth nitrate, dibutyl tin dilaurate, zinc acetonyl acetonate, ferric acetonyl acetonate, lead acetate, stannous octoate, zirconium nitrate and mixtures thereof. Salt concentrations in the liquid medium may range from about 0.3 molar to about 0.75 molar. In certain instances, such as when the liquid medium comprises n-butyl amine, the salt concentration can be as much as 2.4 molar.

While it is not desired to be bound to any particular theory, it is believed that during the operation of the process the active hydrogen containing compound and the solvent act conjointly, the former cleaves the chemical bonds located in the polymer chains, or at the polymer network branch points, and the latter swells the polymer and/or dissolves the filler, thus accelerating the decomposition of the polymer matrix.

As a result of the aforementioned decompositon process, the oxidizers and metallic fuels originally incorporated into the pyrotechnic are freed, reclaimed and saved for use in the manufacture of future pyrotechnic materials. Once these valuable filler materials have been freed from the pyrotechnic material, any state-of-the-art means can be used to effect separation. These methods include, but are not limited to settling and decanting, washing, filtration, centrifuging, evaporation and drying, and dissolving the filler in a solvent, precipitating it out and mixtures thereof.

The invention is further illustrated by the following examples in which all parts and percentages are by weight unless otherwise indicated.

Table I shows the effectiveness of primary and secondary amines as the sole component of the liquid medium. The pyrotechnic materials which were treated were (I) a polyurethene-based composite prepared from the reaction of polyethylene glycol, trimethylolpropane and toluenediisocyanate, and (II) a polyamide polyester copolymer based composite propellant prepared from the reaction of carboxyl-terminated polybutadiene, tris(2-methylaziridinyl-1) phosphine oxide (MAPO) and EPON 812.

TABLE I

| Active Hydrogen Containing Compound | Reaction Temperature | Reaction Time | Propellant Type |
|---|---|---|---|
| piperidine | 110° C | 1 hr & 15 min. | I |
| " | 50° C | 5 days | I |
| N,N-dimethyl-1,3-propanediamine | 110° C | 45 min. | I |

TABLE I-continued

| Active Hydrogen Containing Compound | Reaction Temperature | Reaction Time | Propellant Type |
|---|---|---|---|
| " | 50° C | 4 days | I |
| " | 50° C | 9 hrs. | II |
| 3-methoxy-propylamine | 110° C | 1 hr & 4 min. | I |
| " | 50° C | 4 days | I |
| " | 50° C | 13 hours | II |
| benzylamine | 110° C | 2 hrs & 5 min. | I |
| " | 50° C | 15 days | I |
| " | 50° C | 9 hours | II |
| 3-aminopropyl-morpholine | 110° C | 1 hr & 22 min. | I |
| " | 50° C | 5 days | I |
| n-hexylamine | 110° C | 48 min | I |
| " | 50° C | 4 days | I |
| " | 50° C | 6 hrs. | II |
| di-n-butylamine | 110° C | 1 hr & 35 min. | I |
| " | 50° C | undecomposed after 14 days | I |
| 3-propanolamine | 110° C | 6 hrs | I |
| " | 50° C | undecomposed after 14 days | I |
| n-butylamine | R.T. | 15 hrs & 30 min. | I |
| " | 50° C | 4 hrs & 30 min. | II |
| " | R.T. | approx. 16 hrs. | II |

R. T. = Room Temperature

The following examples show the effectiveness of various combinations of active hydrogen containing compounds and solvents which comprise the liquid medium. It should again be noted that in examples where an amine was employed in toluene or xylene, addition of propanol to the mixture would be desirable in order to dissolve any substituted ammonium perchlorate formed and thereby reduce shock sensitivity.

EXAMPLE 1

Eight composite propellant stocks were prepared from hydroxyl-terminated polyethers, polyesters, and polybutadiene and from carboxyl-terminated polybutadiene, as shown in Table II. Crosslinking agents and various fillers such as those described above were utilized. The stocks were cured to a hard solid condition and were insoluble in all solvents at ambient temperatures.

TABLE II

COMPOSITION OF COMPOSITE PROPELLANT STOCKS

| Stock No. | Binder Polymer[a] | Type Curing Agent | Chem. Groups at Branch Points | Fillers[b] |
|---|---|---|---|---|
| I | Polyether | Isocyanate | Urethane | AP,HBNQ |
| II | Polyether | Isocyanate | Urethane | AP, Al |
| III | Polyether | Isocyanate | Urethane | RDX |
| IV | Polyether-Polyester | Isocyanate | Urethane | AP, HBNQ |
| V | Polybutadiene | Isocyanate | Urethane | AP |
| VI | Polybutadiene | Imine | Amide, Ester | AP, Al-High Solids |
| VII | Polybutadiene | Imine | Amide, Ester | AP, Al-Low Solids |
| VIII | Polybutadiene | Epoxide | Ester | AP, Al |

[a]Stock III contained polyethylene oxide. All other polyethers were polypropylene oxide or polytetramethylene oxide.
[b]AP = $NH_4ClO_4$, HBQN = Nitroguanidine RDX = Cyclotrimethylene trinitramine Pieces of stocks, I, II, IV, V, VI, VII, and VIII, weighing about 35 grams and cut into samples having dimensions of $1 \times 1 \times \frac{1}{2}$ inch (approximately $2.5 \times 2.5 \times 1.3$ cm.), were placed in closed containers with 75 ml of mixed xylene containing 0.5 percent ethylene diamine. The samples were heated to 115° C. After 24 hours, the stocks disintegrated, the binder portion was in solution, and the fillers had collected on the bottom of the containers.

The experiment was repeated using 0.5 percent ethanolamine in xylene. The result was the same except that the time required for degradation increased to 36 hours for stock II, to 2 days for stocks I and V and to 4 days for stock VII. Diethanolamine was less effective than ethanolamine. Toluene and benzene were also effective solvents for the process. Their boiling points being lower than xylene, lower temperatures were employed and longer times were required. At 100° C, breakdown of Stock VII in toluene containing 0.5 percent ethylene diamine required 72 hours; at 80° C, 120 hours were needed. With 2 percent ethylene diamine, Stock VII required 48 hours at 100° C and 72 hours at 80° C for decomposition in toluene. At 0.2 percent ethylene diamine in toluene, 120 hours are needed at 100° C to break down Stock VII, and more than a week at 80° C.

The results of Example I indicates that ethylene diamine and ethanolamine in combination with either xylene or toluene, as solvents, effectively decompose composite propellants comprising a polymer binder selected from among (a) polyurethanes prepared from a polyisocyanate curing agent and a prepolymer selected from the group consisting of a polyether, a polyester, a polyether-polyester copolymer, and a hydroxyl-terminated polybutadiene, (b) polyamides which may contain polyester groups prepared from an imine curing agent, and a carboxyl-terminated polybutadiene, and (c) polyesters prepared from an epoxide curing agent and a carboxyl terminated polybutadiene, and a filler material such as ammonium perchlorate, aluminum, nitroguanidine and mixtures thereof. As can be seen in the above example, a suitable liquid medium contains from about 0.2 percent to about 2 percent of the active hydrogen containing compound in the liquid medium.

EXAMPLE 2

Degradation of unfilled stocks similar to stocks V and VI or VII occurred readily in xylene at 80° to 100° C in the presence of 2 percent ethylene diamine, diethylene triamine, or tetraethylene pentamine. A longer time is required when the amine was ethanol amine or hexylamine. Diethanol amine, choline, and dimethylaminoethyl alcohol are less effective.

EXAMPLE 3

About 35 grams each of the cured stocks described in Table II were cut into $1 \times 1 \times \frac{1}{2}$ inch samples ($2.5 \times 2.5 \times 1.3$ cm) and placed in closed containers with 75 ml of 6N solution of aqueous ammonia ($NH_4OH$). The samples were heated at 99° C. The best results were obtained with stocks, I, II, IV, VI and VIII, wherein after 24 to 48 hours, the stocks were found to be broken down forming soft, shapeless, gummy masses on the bottoms of the containers with most of the $NH_4ClO_4$ in the water solution. Aluminum, when present, was retained occluded in the binder. The nitroguanidine in Stocks I and IV was largely destroyed by the alkaline treatment. After removal from the water phase and drying, the resinous masses from stocks I, II, IV, VI and VIII were found to be soluble in benzene. Once dissolved, these masses released their aluminum which fell to the bottom of the container. Aqueous ammonia at a 1.5N concentration was also effective but degradation was slower than with the 6N solution.

Where aqueous ammonia was effective in breaking down a cured stock, ethylene diamine in water was also effective but a longer time was acquired.

The results of Example 3 indicate that either ammonia or ethylene diamine in combination with water as a solvent effectively decomposes composite propellants comprising a polymer binder selected from among (a) polyurethanes prepared from a polyisocyanate curing agent and a prepolymer selected from the group consisting of a polyether, a polyester, a polyether-polyester copolymer, and a hydroxyl terminated polybutadiene, (b) polyesters derived from an epoxide curing agent and a carboxyl terminated polybutadiene, and (c) polyamides which may contain polyester groups are derived from an imine curing agent and a carboxyl terminated polybutadiene, and a filler such as ammonium perchlorate, aluminum or mixtures thereof.

EXAMPLE 4

The experiment described in Example 2 was repeated using as the liquid medium 1.5N hydrochloric acid solution in water instead of ammonium hydroxide. The containers were loosely covered. The best results were obtained with stocks I, IV, and VI which were broken down after 48 hours at 99° C to soft, shapeless, gummy masses expanded with bubbles where aluminum was present. Stock II required six days to decompose. This method has the advantage of retaining nitroguanidine in stocks I, and IV substantially unchanged provided the heat treatment is not too long. The metallic aluminum is converted into an aluminum salt. Mineral acids other than HCl were equally effective.

EXAMPLE 5

Stock III was very difficult to decompose. The binder of this stock was composed chiefly of polyethylene oxide which is water soluble before cure. The filler was cyclotrimethylenetrinitramine (RDX) which is sensitive to bases but more stable to acids. Neither acids, amines nor aqueous ammonia was effective in decomposing this material. However, decomposition was complete in 24 hours when the treating solvent was a cyclohexanone-propanol solution containing 2.5 percent or more water and acids such as hydrochloric acid at 0.5N concentration or higher. The cyclotrimethylenetrinitramine is soluble in cyclohexanone. Other solvents such as dimethyl sulfoxide, deimethyl formamide, n-methyl pyrrolidone, butyrolactone, and cyclopentanone are also effective when used instead of cyclohexanone.

Disintegration of Stock III also took place in 48 hours at 100° C in cyclohexanone containing 2 percent ethylene diamine. However, under these basic conditions the cyclotrimethylene trinitramine may be destroyed.

The following two examples set forth procedures for the recovery of filler materials such as ammonium perchlorate and aluminum from composite propellants.

EXAMPLE 6

The cured binder of stock VI was broken down and went into solution at 120° C in 4 hours or at 100° C at 12 hours in xylene or toluene containing 2 percent ethylene diamine. The $NH_4ClO_4$ and aluminum in the propellant fell to the bottom of the container. The solution was decanted off. The residue was washed with toluene and dried. On addition of water, the $NH_4ClO_4$, containing traces of perchlorate of ethylene diamine, dissolved leaving the aluminum. On evaporating the separated aqueous solution nearly to dryness, the $NH_4ClO_4$ precipitated leaving the brown colored ethylene diammonium perchlorate in solution. The particle size of recovered aluminum was 68 microns the same as originally used in the propellant mix. Recovery of aluminum was 98 percent of that introduced into the mix and recovery of ammonium perchlorate was 85 percent.

EXAMPLE 7

Stock VI, was degraded in 1.5N ammonium hydroxide solution at 100° C. About 12 hours time was required. The binder formed a soft shapeless mass. The water solution was decanted off, the binder was washed with hot water which was added to the water solution, and the water was evaporated off to yield $NH_4ClO_4$. The binder was dried and dissolved in benzene and the occluded aluminum and some residual $NH_4ClO_4$ fell to the bottom of the reaction vessel. The benzene solution was decanted off. The residue was washed by decantation with benzene, acetone, and finally with water. It was then dried leaving aluminum powder.

The recovered aluminum (92% yield) had a density of 2.69 at 28° C compared with a known value for aluminum of 2.704 at 20° C. Particle size was 78 microns. Recovery of aluminum was 92 percent of that introduced into the mix, and recovery of ammonium perchlorate was 75 percent.

The following example shows the use of an ammonium salt additive in conjunction with ammonia as the active hydrogen containing compound.

EXAMPLE 8

A 0.25g sample of the polyurethane derived from polyethyleneglycol, trimethylolpropane and a 3-nitraza pentane 1,5-diisocyanate is placed into a 75 ml high pressure bomb with 25 ml of liquid ammonia plus one gram of ammonium chloride. On heating at 50° C for five days or on standing at room temperature for eight days, followed by removal of the ammonia, an amorphous rubber is obtained which was soluble in chloroform.

Thus it is apparent that there is provided by this invention a solvolytic method for decomposing pyrotechnic materials having crosslinked polymers, and reclaiming the valuable fillers contained therein.

It is to be understood that what has been described is merely illustrative of the principles of the invention and that numerous arrangements in accordance with this invention may be devised by one skilled in the art without departing from the spirit and scope thereof.

What is new and desired to be secured by Letters Patent of the United States is:

1. A method of decomposing pyrotechnic materials having a chemically crosslinked polymeric binder component, which comprises;

placing said pyrotechnic material into a liquid active hydrogen containing compound selected from the group consisting of primary amines, secondary amines, ammonia, mineral acids, alcohols, water and mixtures thereof;

heating said pyrotechnic material and said liquid active hydrogen containing compound to a temperature between about 50° C and about 160° C;

reacting said liquid active hydrogen containing compound with said chemically crosslinked polymeric binder component; and cleaving the chemical bonds in said chemically crosslinked polymeric binder component.

2. The method of claim 1 wherein said pyrotechnic material is selected from the group consisting of a composite propellant and a plastic bonded explosive.

3. The method of claim 1 wherein said chemically crosslinked polymeric binder components are selected from the group consisting of a polyurethane, a polyester and a polyamide.

4. The method of claim 1 wherein said primary and secondary amines are selected from the group consisting of diisopropylamine, di-n-butylamine, ethylenediamine, n-butylamine, n-hexylamine, monoethanolamine, 3-propanolamine, diethanolamine, diethylene triamine, tetraethylene pentamine, N,N-dimethyl-1,3-propanediamine, 3-methoxy-propylamine, benzylamine, piperidine, and 3-aminopropylmorpholine.

5. The method of claim 1 wherein said mineral acids are selected from the group consisting of hydrochloric acid, sulfuric acid, phosphoric acid, nitric acid, and perchloric acid.

6. The method of claim 1 wherein a solvent miscible with said liquid active hydrogen containing compound and capable of straining said chemically crosslinked polymeric binder component by swelling the organic polymer or dissolving filler materials is added to said liquid active hydrogen containing compound to form a liquid medium.

7. The method of claim 6 wherein the acitve hydrogen containing compound is present in the liquid medium in an amount of from about 0.2 percent to about 2 percent by weight.

8. The method of claim 6 wherein said solvent is selected from the group consisting of water, liquid amine, liquid ammonia, diethyl, benzene, xylene, toluene, benzene, perchloroethylene, cyclohexanone, dioxane and ethylene glycol.

9. The method of claim 8 wherein said solvent is selected from the group consisting of xylene and toluene.

10. The method of claim 6 wherein the liquid medium further comprises at least one salt selected from the group consisting of a metal salt an ammonium salt, wherein the ammonium salt is selected from the group consisting of ammonium perchlorate, ammonium chloride, ammonium bromide, ammonium iodide, ammonium thiocyanate, ammonium benzoate, ammonium acetate and mixtures thereof; and the metal salt is selected from the group consisting of bismuth nitrate, dibutyl tin dilaurate, zinc acetonyl acetonate, ferric acetonyl acetonate, lead acetate, stannous octoate, zirconium nitrate, and mixtures thereof.

11. The method of claim 10 wherein the concentration of salt in said liquid medium lies between about 0.3 molar and about 2.4 molar.

12. The method of claim 1 wherein said temperature lies between about 80° and about 120° C.

13. A process for reclaiming oxidizers, metallic fuels, and mixtures thereof from pyrotechnic materials having a chemically crosslinked polymeric binder component selected from the group consisting of a polyurethane, a polyamide and a polyester, which comprises the steps of:

decomposing said pyrotechnic material by placing said pyrotechnic material into a liquid active hydrogen containing compound, selected from the group consisting of primary amines, secondary amines, ammonia, mineral acids, alcohols, water and mixtures thereof, heating said pyrotechnic and said liquid active hydrogen containing compound to a temperature ranging from about 50° C to about 160° C, and reacting said liquid active hydrogen containing compound with said chemically crosslinked polymeric binder component so as to cleave the chemical bonds in the polymer chain and at the polymer network branch points thereby freeing said oxidizers, metallic fuels and mixtures thereof; and separating said oxidizers, metallic fuels and mixtures thereof from the decomposed pyrotechnic material.

14. The process of claim 13 wherein said primary and secondary amines are selected from the group consisting of diisopropylamine, di-n-butylamine, ethylenediamine, n-butylamine, n-hexylamine, monoethanolamine, 3-propanolamine, diethanolamine, diethylene triamine, tetraethylene pentamine, N,N-dimethyl-1,3-propanediamine, 3-methoxy propylamine, benzylamine, piperidine, and 3-aminopropylmorpholine.

15. The process of claim 13 wherein said mineral acids are selected from the group consisting of hydrochloric acid, sulfuric acid, phosphoric acid, nitric acid, and perchloric acid.

16. The process of claim 13 wherein a solvent miscible with said liquid active hydrogen containing compound and capable of straining said chemically cross-linked polymeric binder component by swelling the organic polymer or dissolving filler materials is added to said liquid active hydrogen containing compound to form a liquid medium.

17. The process of claim 16 wherein the active hydrogen containing compound is present in the liquid medium in an amount of from about 0.2 percent to about 2 percent by weight.

18. The process of claim 16 wherein said solvent is selected from the group consisting of water liquid amine, liquid ammonia, diethyl benzene, xylene, toluene, benzene, perchloroethylene, cyclohexanone, dioxane and ethylene glycol.

19. The process of claim 18 wherein said solvent is selected from the group consisting of xylene and toluene.

20. The process of claim 16 wherein the liquid medium further comprises at least one salt selected from the group consisting of a metal salt and an ammonium salt, wherein the ammonium salt is selected from the group consisting of ammonium perchlorate, ammonium chloride, ammonium bromide, ammonium iodide, ammonium thiocyanate, ammonium benzoate, ammonium acetate and mixtures thereof; and the metal salt is selected from the group consisting of bismuth nitrate, dibutyl tin dilaurate, zinc acetonyl acetonate, ferric acetonyl acetonate, lead acetate, stannous octoate, zirconium nitrate, and mixtures thereof.

21. The process of claim 20 wherein the concentration of salt in said liquid medium lies between about 0.3 molar and about 2.4 molar.

22. The process of claim 13 wherein said separation process is selected from the group consisting of settling and decanting, washing, filtration, centrifuging, evaporation, drying, dissolving, precipitating and mixtures thereof.

* * * * *